US005985365A

United States Patent [19]

Jaye

[11] Patent Number: 5,985,365

[45] Date of Patent: Nov. 16, 1999

[54] METHOD AND AUTOMATED APPARATUS FOR GALVANIZING THREADED RODS

[75] Inventor: W. David Jaye, Katy, Tex.

[73] Assignee: Galvanizing Services Co., Inc., Jasper, Tenn.

[21] Appl. No.: 09/174,079

[22] Filed: Oct. 16, 1998

Related U.S. Application Data

[60] Provisional application No. 60/063,756, Oct. 17, 1997.

[51] Int. Cl.[6] ..... B05D 1/18; B05D 3/12; B05C 3/10

[52] U.S. Cl. ..... 427/241; 427/347; 427/298.3; 427/433; 118/56; 118/416; 118/426; 118/428

[58] Field of Search ..... 427/241, 347, 427/398.3, 433; 118/426, 416, 428, 56

[56] References Cited

U.S. PATENT DOCUMENTS

| | | | |
|---|---|---|---|
| 663,034 | 12/1900 | Lynch . | |
| 1,141,930 | 6/1915 | Buch . | |
| 1,727,354 | 9/1929 | Newhall | 427/347 |
| 2,124,520 | 7/1938 | Speller . | |
| 2,184,610 | 12/1939 | Church . | |
| 2,856,895 | 10/1958 | Anderson . | |
| 3,030,226 | 4/1962 | Heaton . | |
| 3,105,774 | 10/1963 | Segraves . | |
| 4,299,189 | 11/1981 | Hagberg | 118/675 |
| 4,353,941 | 10/1982 | Bowman | 427/398.3 |

*Primary Examiner*—Katherine A. Bareford
*Attorney, Agent, or Firm*—James L. Jackson; Mayor, Day, Caldwell & Keeton, L.L.P.

[57] ABSTRACT

An automated method and apparatus for galvanizing threaded rods, comprising conveying threaded rods while horizontally oriented through a bath of molten zinc, then simultaneously spinning the threaded rods in horizontal orientation at sufficient rotational velocity to remove excess molten zinc therefrom by centrifugal force and conveying the threaded rods to a cooling bath. The automated apparatus then conveys the zinc coated threaded rods through a cooling bath to solidify the molten zinc coating and then collects cooled zinc coated threaded rods to permit efficient removal thereof from the apparatus. A rotary conveyor mechanism of the automated apparatus conveys the threaded rods through a molten zinc bath and removes excess molten zinc therefrom by rolling the coated threaded rods down an inclined zinc removal platform. As the rods roll down the zinc removal platform they achieve sufficient rotary velocity to develop predetermined centrifugal force for removal of the minute excess molten zinc that remains after removal of the threaded rods from the molten zinc bath. After excess molten zinc removal the apparatus conveys the threaded rods through a cooling trough to solidify the zinc coating.

6 Claims, 2 Drawing Sheets

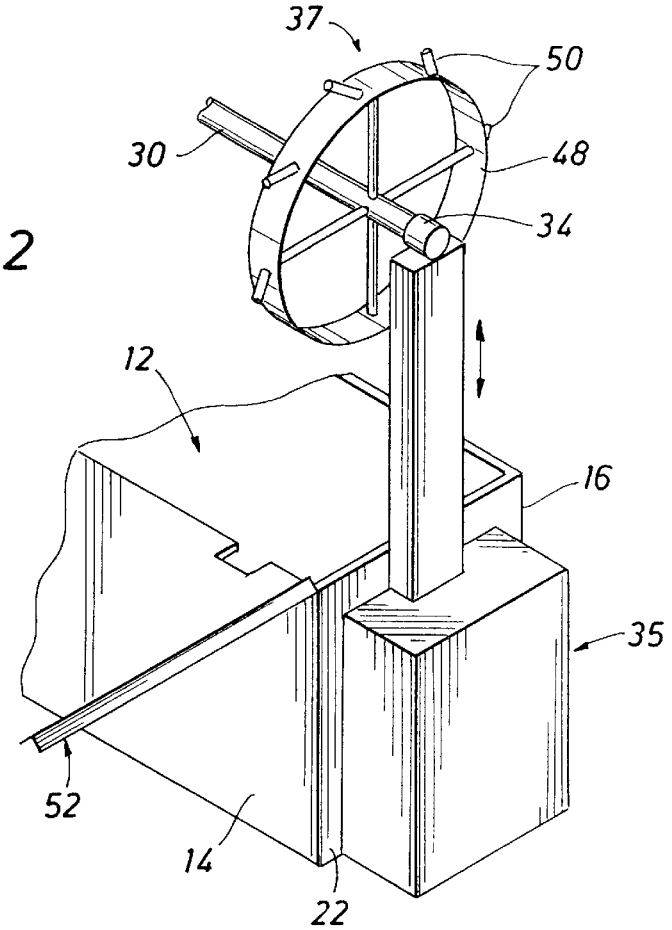
FIG. 2
FIG. 3
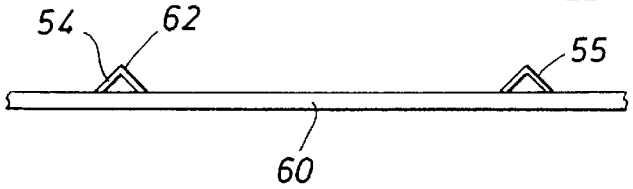
FIG. 4
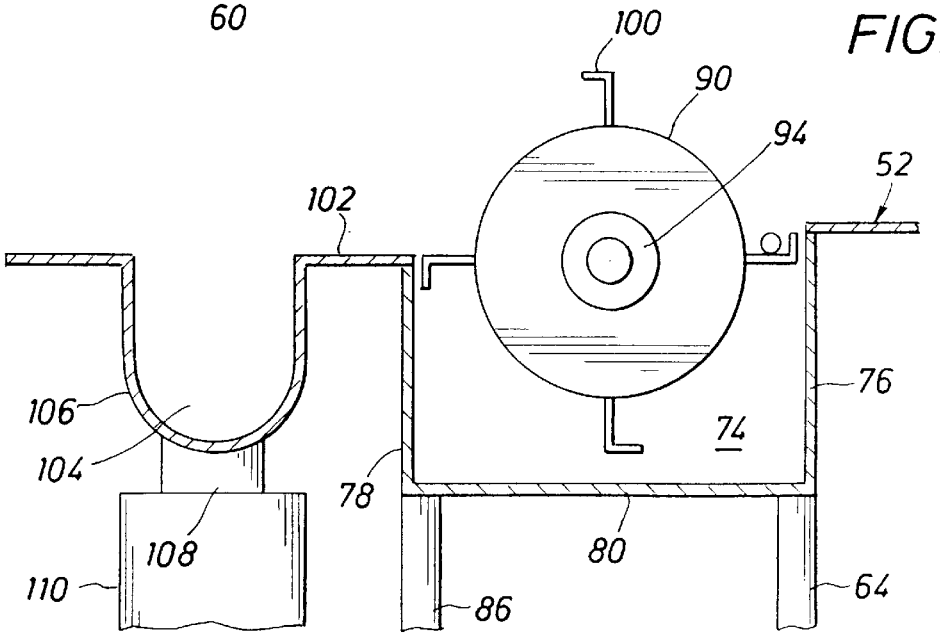

METHOD AND AUTOMATED APPARATUS FOR GALVANIZING THREADED RODS

The benefit of United States Provisional Application Ser. No. 60/063,756 filed on Oct. 17, 1997 of W. David Jade and entitled Automated Galvanizing Mechanism For Threaded Rods is hereby claimed. The subject matter of such Provisional Application is incorporated herein by reference for all purposes.

BACKGROUND OF THE INVENTION

1. Field of the Invention

This invention relates generally to processes and equipment for galvanizing threaded rods and more particularly concerns a method and apparatus for dipping cleaned and prepared threaded rods in molten zinc, efficiently removing excess molten zinc from the dipped threaded rods and then cooling the threaded rods to solidify the molten zinc coating thereof. Even more particularly the present invention concerns a method and apparatus for achieving sufficient rotational velocity of threaded rods, immediately following molten zinc dipping, to cause removal of excess molten zinc by centrifugal force as the rods move from a zinc dipping station to a cooling station.

2. Background of the Invention

Within the hot-dip galvanizing industry, there exists a need to galvanize threaded rod material in large quantities. Manual hot-dipping of threaded rods is too slow and too labor intensive to allow for competitive pricing of the rods when sold to the end user. In addition, it is imperative that the threads of the finished galvanized rod be clean and smooth so as to allow for the application of a nut. This is known as 'nut-ability' and is the single, most crucial requirement in the process of hot-dip galvanizing of threaded rods. To achieve nut-ability the excess molten zinc that typically adheres to threaded rods after the rods have been removed from the molten zinc bath must be removed so that the resulting solidified zinc material will not interfere with application of nuts to the threads of the rods.

Existing Methods Within the Industry

Currently, two methods are typically used to achieve hot-dip galvanizing of threaded rods. One method is to manually dip the rods in molten zinc using hooks and to then "sling" off the excess molten zinc as best as possible using a variety of manual methods. As mentioned above, this process is slow, quite costly from the standpoint of labor and the results are varied, producing a very low yield of usable product. The second most common method is to hang the rods vertically, typically in rod support cage devices, depending on rod thickness, and then dipping them into a molten zinc bath. As the threaded rods are lifted from the zinc, a motorized device above spins cage device containing the rod or rods and slings off the excess molten zinc from the threads, thus removing the excess molten zinc centrifugally. This zinc removal process is followed by dipping the hot rods in cold water to quench the rods and solidify the molten zinc. This process produces superior results from the standpoint of quality but the process is limited by the number of rods that the spinning device can handle at one time. In addition, the cages for holding the rod or rods must be cleaned of excess zinc and manually loaded and unloaded for each batch so that labor requirements for this type of galvanizing process are typically significant. This cleaning, loading and unloading is a time consuming process that depends on significant human interaction and is therefore susceptible not only to various yields of finished product, but increases the chance for injury to workers and damage to the product.

SUMMARY OF THE INVENTION

It is a principal feature of the present invention to provide a novel automated galvanizing process for threaded rods which yields a high volume yield of high quality finished product with minimal labor requirements, thus significantly enhancing the commercial viability of the galvanizing process;

It is another feature of the present invention to provide a novel automated galvanizing process for threaded rods which achieves removal of excess molten zinc from the threaded rods by centrifugal force;

It is an even further feature of the present invention to provide a novel automated galvanizing process for threaded rods which achieves application of centrifugal force to the molten zinc coating of the threaded rods by rolling the hot coated threaded rods down an incline ramp of sufficient inclination and length to force the excess molten zinc therefrom.

It is an even further feature of the present invention to provide novel automated galvanizing apparatus for threaded rods which causes zinc coating, excess zinc removal and cooling of the coated threaded rods in an operational sequence that requires virtually no worker intervention, control or handling; and It is another feature of the present invention to provide novel automated galvanizing apparatus for threaded rods which permits zinc coating, centrifugal excess molten zinc removal and cooling of the threaded rods while maintaining the threaded rods in substantially horizontal orientation during the entire galvanizing process.

New Method for Hot Dip Galvanizing of Threaded Rods

Briefly, in accordance with the principles of the present invention the rod orbiting device, allows for the total automation of a hot-dip galvanizing process for threaded rods. The end result of this novel threaded rod galvanizing process is: 1) A higher yield by more than double the best the industry currently has to offer and 2) Reduced interaction between workers and the rods being galvanized so that labor costs are minimized and worker safety is enhanced.

The rod orbiting mechanism of the present invention consists of four basic sections:

A) A plurality of guide wheels for moving the rods through the molten zinc and back out to open air.

B) A zinc removal platform where the threaded rods lose molten excess zinc while transferring from a rod dipping station to a cooling position.

C) A quench tank or receptacle where the hot rods are cooled after exiting the zinc removal platform.

D) A holding or collection bay where the galvanized threaded rods are automatically deposited after being cooled in the quench tank.

The rod orbiting device operates as follows:

The guide or conveyor wheels, which resemble the steering devices found on old sailing ships; are round and are provided with 'spokes' that protrude along the outer circumference of each guide wheel. A guide wheel assembly is defined multiple pairs of these guide wheels mounted on a common shaft driven by a variable speed gear motor. The guide wheel assembly is capable of being raised and lowered with respect to the molten zinc bath. The guide wheel assembly is lowered into the molten zinc while oriented horizontally and locked into position with the central axle of the guide wheel assembly resting a few inches above the surface of the molten zinc. Under the surface of the molten zinc, the 'spokes' of the guide wheels are aligned with metal U-shaped guide straps that have ends thereof connected to each side of the molten zinc tank As the threaded rods are conveyed through the molten zinc bath the path of movement thereof follows the contour of the guide wheels so that the threaded rods exit at the surface of the molten zinc bath on the opposite side of the tank. The spokes of the guide wheels lift the coated threaded rods from the zinc bath, allowing most of the excess molten zinc to drip from the rods and fall back into the zinc bath.

As the guide wheels turn, workers place individual threaded rods horizontally onto the 'spokes'. The rotary action of the guide wheels lowers the rods into the molten zinc at a pre-determined rate via the variable speed gear motor. The metal U-shaped straps prevent the rods from dropping off the spokes as they push the rods down through the bottom of the tank and back up the other side. The metal U-shaped straps also serve to guide the movement of the threaded rods through the zinc bath and prevent them from falling to the bottom of the zinc bath. In effect, the rods are placed on the spokes of one side of the guide wheel and exit the molten zinc on the opposite side, allowing continuous loading of new rods.

As the rods exit the tank, the threads are full of excess molten zinc which must be removed quickly before it solidifies and prevents nut-ability of the finished rods. An inclined set of rails, known as a zinc removal platform, is positioned next to the molten zinc tank of the zinc bath. As the rods exit the tank, they roll off due to gravity and land at the top end of the inclined rails. Again gravity takes over and, as the hot rods roll down the inclined zinc removal platform, centrifugal force slings off the still molten zinc at a very high rate. This spinning action continues until the very last second as the now clean rods fall off the lower end of the zinc removal platform and land in the water of the quench tank where they are immediately cooled. The rods are automatically lifted from the water or other coolant of the quench tank using a set of turning metal 'spokes', similar to the guide wheels, and are deposited into a U-shaped trough or other suitable receptacle forming the holding bay. While resting in the holding bay, the now cool rods are bundled together and prepared for shipping back to the customer or to an end user.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration of automated apparatus for galvanizing threaded rods which is constructed in accordance with the principles of the present invention and represents the preferred embodiment of this invention;

FIG. 2 is a partial isometric illustration of the apparatus of FIG. 1, showing means for raising and lowering the rotary guide and conveyor assembly relative to the molten zinc tank;

FIG. 3 is a partial elevational view of the zinc removal platform of FIG. 1, showing the construction thereof in detail; and FIG. 4 is a partial elevational view of the cooling trough and rotary rod lift mechanism of FIG. 1, showing the structure thereof in detail.

DETAILED DESCRIPTION OF PREFERRED EMBODIMENT

Figure 1:
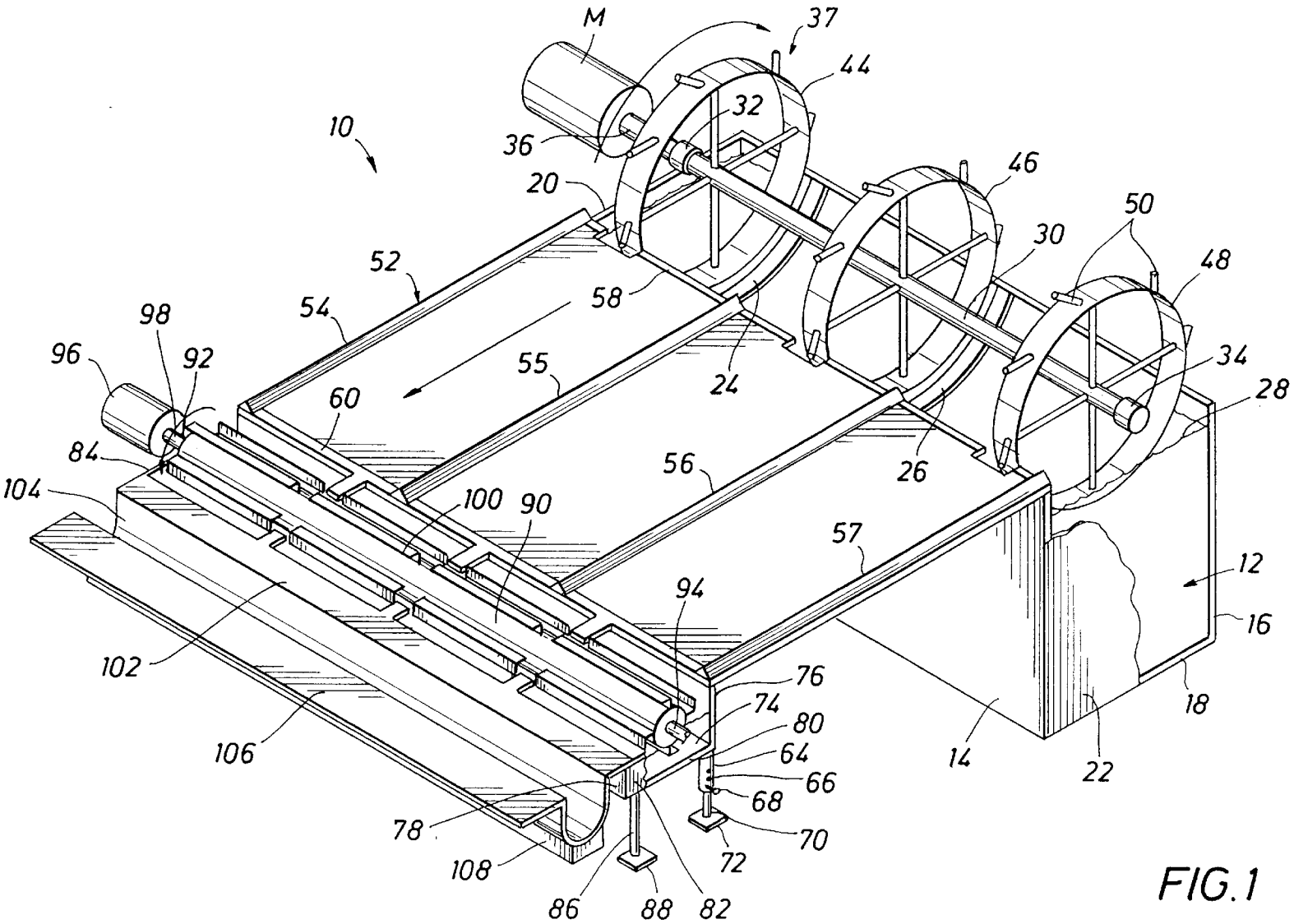

Referring now to the drawings and first to FIG. 1 automated apparatus for galvanizing threaded rods according to the method hereof is accomplished by an automated threaded rod galvanizing mechanism shown generally at 10 which has a molten zinc bath incorporating a tank is shown generally at 12 and is defined by sidewalls 14 and 16 a bottom wall 18 and end walls 20 and 22 which are shown to be cut away for the purpose of showing the interior of the molten zinc bath. A plurality of U-shaped guide straps 24 and 26 are located within the molten zinc bath, with respective ends thereof being connected in any suitable fashion to the upper portion of the sidewalls 14 and 16 so that the U-shaped straps extend from side to side of the tank of the molten zinc bath. These U-shaped guide straps provide support for threaded rods that are being conveyed through the molten zinc material 28 that is located within the molten zinc bath. The U-shaped guide straps are situated such that threaded rods being supported thereby as they are conveyed through the molten zinc bath. The threaded rods will be passed well beneath the surface of the molten zinc within the bath for the purpose of ensuring that the threaded rods are completely coated with the molten zinc composition. It should be borne in mind that the term "molten zinc" as utilized in conjunction with the present invention is intended to mean zinc or any mixture of zinc and other metals for the purpose of providing threaded rods with a protective metal coating.

For conveying the threaded rods through the molten zinc bath 12 a conveyor shaft 30 is mounted horizontally and is supported for rotation by bearing means which may comprise two or more bearings such as shown at 32 and 34, with the bearings being supported by elevating means shown generally at 35 for raising and lowering a rotary guide and conveyor assembly shown generally at 37 relative to the molten zinc bath as will be described in detail hereinbelow. The elevating means may take the form of a hydraulic lift mechanism, mechanical or electromechanical lift mechanism without departing from the spirit and scope of the present invention. The rotary threaded rod conveyor shaft 30 is rotatably driven by the output shaft 36 of a synchronous rotary motor M which may be mounted to the machine structure or to adjacent structure so as to be fixed and positioned for achieving rotation of the horizontally oriented threaded rod drive shaft 30.

For conveying the threaded rods through the molten zinc bath a plurality of rod guide wheels 44, 46 and 48 are connected in spaced relation along the length of the molten zinc bath and are connected in rotary driven relation with the rotary drive shaft 30. Thus the guide wheels will be rotated as the rotary drive shaft 30 is driven by the output shaft 36 of the synchronous drive motor. Each of the rod guide wheels is provided with a plurality of rod conveying spoke elements 50 which are inclined with respect to the outer periphery of the guide wheels and thus form cradles that receive and convey the threaded rods through the molten zinc bath. Workers will typically place the threaded rods individually or in small groups on the cradles defined by the inclined spoke elements or in the alternative the rods may be fed to the guide wheels by any suitable conveyor mechanism. Movement of the threaded rods through the molten zinc bath and along the U-shaped guide straps is controlled by the rod conveying spoke elements 50 of the rotary guide wheels. The threaded rods are also guided during movement through the molten zinc bath by the U-shaped guide straps 24 and 26. As the guide wheels 44, 46 and 48 are rotated in the direction of the rotation arrow shown in FIG. 1, the threaded rods are conveyed through the molten zinc bath and are guided by the U-shaped guide straps. The U-shaped guide elements also ensure that the threaded rods remain contained within the cradles defined by the spokes 50 as the threaded rods are conveyed through the molten zinc bath. The rod conveying spoke elements 50 also provide a lifting function to lift the zinc coated threaded rods from the molten zinc bath, permit excess molten zinc to drip therefrom and to deposit the threaded rods individually or in small groups onto a zinc removal platform shown generally at 52. As the threaded rods are being lifted from the molten zinc bath, most of the excess molten zinc drips therefrom and return to the bath, but for quality of the zinc coating and nut-ability of the finished galvanized threaded rods the remaining excess molten zinc should be centrifugally removed by spinning the threaded rods. The zinc removal platform is shown in FIG. 1 as having a plurality of structural guide rail members 54 ,55, 56, and 57 which are welded or otherwise fixed to horizontal support members 58 and 60. The guide rail members are of such length and inclination as to cause the threaded rods to rotate at sufficient velocity to throw off excess molten zinc by centrifugal force.

As shown in the partial elevational view of FIG. 3, the structural rail members are in the form of angle members each having the apex 62 thereof facing upwardly. This upward facing orientation of the angle type structural rail members permits molten zinc being thrown from the spinning zinc coated threaded rods to fall to the floor or to another receptacle located beneath the zinc removal platform. Typically, this minute excess of molten zinc will fall from the threaded rods in dust-like small particulate form during spinning so that it is not ordinarily reclaimed. Rather, it is typically periodically swept up and discarded.

The inclined zinc removal platform 52 is supported by adjustable support leg assemblies each having a tubular leg 64 having a plurality of spaced positioning pin receptacles 66. A telescoping leg member 70 is received within the tubular leg 64 and is provided with a support foot 72 at its lower end for supporting engagement with a floor or any other suitable structure. A positioning pin 68 is receivable within aligned positioning receptacles of the tubular leg 64 and the telescoping leg member 70 for securing the telescoping leg member in a selected position relative to the fixed tubular leg 64. This feature permits adjustment of the inclination of the zinc removal platform 52 and thus provides for selective control of The rotational velocity of the threaded rods as they progress toward a cooling bath during centrifugal zinc removal. This feature also permits the zinc removal platform to be adjustable for threaded rods of differing size, so that the rotational velocity of the threaded rods can be effectively controlled as they roll down the inclined zinc removal platform.

At the lower end of the zinc removal platform 52 is located a cooling bath 74 which is defined by a rear wall 74, a front wall 78 and a bottom wall 80. End walls 82 and 84 close the respective ends of the cooling bath and assist the front, rear and bottom walls in containing a quantity of cooling fluid such as water. The upper portion of the cooling bath is open to permit zinc coated threaded rods to roll into the cooling bath from the lower end of the zinc removal platform. The cooling bath structure 74 is also provided with support legs 86 having feet 88 at the lower ends thereof for contact with a floor or other support structure.

For controlled movement of the zinc coated threaded rods through the cooling bath a rotary conveyor 90 is mounted for rotation at least partially within the cooling bath 74. The rotary conveyor is provided with an axial shaft 92 which is supported by bushings or bearings 94. A rotary drive motor 96 is provided, which is connected to the axial shaft 92 by a motor output shaft 98. Rod lifting elements 100 of typically L-shaped configuration project radially outwardly from the rotary conveyor 90 and serve to convey the cooled threaded rods from the cooling bath 74 and to deposit them on a rod receiving platform 102. The cooled zinc coated threaded rods will then roll into a rod collection receptacle 104 which is of generally U-shaped configuration as shown at 106, causing the cooled threaded rods to be collected together for bundling or handling of other character. For support of the rod collection receptacle 104–106, a support member 108 configured to fit the U-shaped bottom wall of the receptacle is provided. This support member is disposed in supported engagement with another support structure 110 as shown in FIG. 4.

Features that Make the Rod Orbiting Device Unique to the Industry

1. Unlike the vertical method for processing threaded rods the rod orbiting device is not limited by the combined weight of a given load of rods to be galvanized.

2. Unlike the vertical method for processing threaded rods, the rod orbiting device can intermix rods of different lengths without having to change any set up configurations.

3. The rod orbiting device requires fewer operators and thus minimizes labor costs.

4. The rod orbiting device limits worker exposure and interaction to loading of the individual threaded rods only. The rest of the hot dip galvanizing process is essentially free of labor requirements since it is substantially controlled by the threaded rod conveying and handling apparatus of the automated galvanizing machine.

These combined differences mean that the rod orbiting device is cheaper, faster and safer without sacrificing the quality required to ensure nut-ability of the finished product.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. An automated method for galvanizing threaded rods, comprising:

(a) moving threaded rods with a set of rotating guide wheels having rod conveying spokes that protrude from the outer circumference of each wheel thereon while said rods are horizontally oriented, through a bath of molten zinc:

(b) with said rod conveying spokes, lifting the molten zinc coated threaded rods from the molten zinc bath;

(c) depositing the molten zinc coated threaded rods from the rotating guide wheels onto a zinc removal platform formed from an inclined set of rails, said rails being sufficiently inclined for achieving sufficient rotational velocity of the molten zinc coated threaded rods for centrifugal force removal of excess molten zinc therefrom;

(d) simultaneously spinning the threaded rods in horizontal orientation and conveying the molten zinc coated threaded rods to a cooling bath by rolling the molten zinc coated threaded rods down the zinc removal platform being sufficiently inclined and of sufficient length to achieve rotation at sufficient rotational velocity to remove excess molten zinc therefrom by centrifugal force;

(e) with rotary rod lift means having rod conveying and lifting elements thereon, moving the zinc coated threaded rods through a cooling bath, to solidify the molten zinc coating thereon;

(f) lifting the zinc coated threaded rods from the cooling bath; and then (g) depositing the zinc coated threaded rods into a rod collection receptacle.

2. Automated apparatus for galvanizing threaded rods, comprising:

(a) a molten zinc bath;

(b) first conveyor means for conveying threaded rods through said molten zinc bath, wherein said first conveyor means comprises (1) threaded rod guide means being located within said molten zinc bath and adapted for support and guiding of threaded rods during conveying thereof through said molten zinc bath;

(2) a plurality of conveyor wheels located at least partially within said molten zinc bath; said wheels having rod conveying spokes that protrude from the outer circumference of each wheel thereon, for moving the threaded rods through the molten bath while said rods are horizontally oriented;

(3) means for imparting simultaneous rotation to said plurality of conveyor wheels for moving threaded rods through said molten zinc bath and along said threaded rod guide means, lifting the threaded rods from the molten zinc bath and depositing molten zinc coated threaded rods onto a zinc removal platform;

(c) the zinc removal platform formed from an inclined set of rails, said rails being disposed for receiving zinc coating threaded rods from said rotary conveyor means and being sufficiently inclined and of sufficient length for achieving sufficient rotational velocity of the molten zinc coated threaded rods for centrifugal force removal of excess molten zinc therefrom and for passage of the threaded rods to a cooling bath;

(d) the cooling bath disposed for receiving molten zinc coated threaded rods from said zinc removal platform;

(e) second conveyor means for conveying molten zinc coated threaded rods through said cooling bath for cooling said zinc coated threaded rods and for solidifing the molten zinc coating thereof wherein the conveyor means includes means being located at least partially within said cooling bath for lifting cooled zinc coated threaded rods from said cooling bath and conveying the zinc coated threaded rods to a finished rod receptacle; and (f) the finished rod receptacle.

3. The automated apparatus of claim 2, said zinc removal platform comprising:

(a) a plurality of rod support and guide rails being disposed in spaced generally parallel relation with one another and having predetermined length; and (b) rod support and guide rail positioning means for selectively establishing sufficient inclination of said rod support and guide rails with respect to said predetermined length thereof for achieving sufficient rotational velocity of the zinc coated threaded rods for centrifugal force removal of excess molten zinc therefrom.

4. The automated apparatus of claim 2, said automated rod support and guide rail positioning means comprising:

zinc removal platform support means supporting one end of said zinc removal platform and being adjustable for selecting the inclination of said zinc removal platform.

5. The automated apparatus of claim 2, comprising:

means for raising and lowering said threaded rod guide means relative to said molten zinc bath.

6. The automated apparatus of claim 2, wherein said rotary rod lift means comprises:

(a) an elongate member being mounted for rotation relative to said cooling bath;

(b) rod lift cradle means being fixed to said elongate member and being oriented for receiving zinc coated threaded rods that fall into said cooling bath; and (c) means for imparting rotary motion to said elongate member for lifting the zinc coated threaded rods from said cooling bath and conveying them to said finished rod receptacle.

* * * * *